US008831493B2

(12) United States Patent
Tanaka et al.

(10) Patent No.: US 8,831,493 B2
(45) Date of Patent: Sep. 9, 2014

(54) IMAGE HEATING APPARATUS

(75) Inventors: Masashi Tanaka, Kawasaki (JP); Kenichi Ogawa, Kawasaki (JP); Satoshi Nishida, Numazu (JP); Kohei Okayasu, Mishima (JP); Shuichi Tetsuno, Kawasaki (JP); Shogo Kan, Suntou-gun (JP); Takaaki Akamatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 13/325,542

(22) Filed: Dec. 14, 2011

(65) Prior Publication Data

US 2012/0155938 A1 Jun. 21, 2012

(30) Foreign Application Priority Data

Dec. 16, 2010 (JP) ..... 2010-280733

(51) Int. Cl.
*G03G 15/20* (2006.01)

(52) U.S. Cl.
CPC ..... *G03G 15/2075* (2013.01); *G03G 15/2025* (2013.01); *G03G 2215/2019* (2013.01)
USPC ..... 399/324; 399/67; 399/327; 399/329

(58) Field of Classification Search
CPC ..... G03G 15/2064; G03G 15/2075
USPC ..... 399/67, 324, 327, 329
See application file for complete search history.

(56) References Cited

U.S. PATENT DOCUMENTS

| | | | | |
|---|---|---|---|---|
| 5,253,024 | A * | 10/1993 | Okuda et al. | 399/324 |
| 5,471,288 | A * | 11/1995 | Ohtsuka et al. | 399/338 |
| 5,724,637 | A * | 3/1998 | Senba et al. | 399/333 |
| 6,763,205 | B2 | 7/2004 | Izawa et al. | |
| 7,155,136 | B2 | 12/2006 | Nihonyanagi et al. | |
| 7,203,438 | B2 | 4/2007 | Omata et al. | |
| 7,519,320 | B2 | 4/2009 | Aoki et al. | |
| 7,650,105 | B2 | 1/2010 | Ogawa et al. | |
| 7,702,249 | B2 | 4/2010 | Nishida | |
| 7,734,241 | B2 | 6/2010 | Nishida et al. | |
| 7,787,792 | B2 | 8/2010 | Nishida | |
| 2003/0118363 | A1 | 6/2003 | Izawa et al. | |
| 2004/0114975 | A1 * | 6/2004 | Sano et al. | 399/328 |
| 2005/0169656 | A1 | 8/2005 | Nihonyanagi et al. | |
| 2010/0135706 | A1 | 6/2010 | Miki et al. | |
| 2010/0260523 | A1 | 10/2010 | Nishida et al. | |
| 2011/0082260 | A1 | 4/2011 | Omata et al. | |
| 2011/0236084 | A1 | 9/2011 | Nishida et al. | |
| 2011/0305474 | A1 | 12/2011 | Tanaka et al. | |
| 2012/0099882 | A1 * | 4/2012 | Tanaka | 399/69 |

FOREIGN PATENT DOCUMENTS

| | | | | |
|---|---|---|---|---|
| JP | 2002139938 A * | 5/2002 | | G03G 15/20 |
| JP | 2003-186327 A | 7/2003 | | |
| JP | 2005-250453 A | 9/2005 | | |

* cited by examiner

*Primary Examiner* — Benjamin Schmitt
(74) *Attorney, Agent, or Firm* — Fitzpatrick, Cella, Harper & Scinto

(57) ABSTRACT

An image heating apparatus for heating a toner image formed on a recording material includes a first rotatable member contactable to the toner image; and a heating unit, including a second rotatable member rotating while contacting a surface of the first rotatable member, for heating the first rotatable member. The toner image on the recording material is heated by receiving heat from the first rotatable member heated by the heating unit. The image heating apparatus further includes a potential controller for maintaining a polarity of a surface potential of the second rotatable member so as to be opposite to a charge polarity of the toner.

13 Claims, 9 Drawing Sheets

| FIXING MEMBER | SURFACE POTENTIAL POLARITY AND AMPLITUDE | | |
|---|---|---|---|
| | A | B | C |
| FILM | +L | + | + |
| ELECTRIC FIELD | ⇩ | ⇩ | ⇩ |
| FIXING ROLLER | +S | −L | − |
| ELECTRIC FIELD | ⇧ | ⇧ | ⇧ |
| PRESSING ROLLER | +L | −S | + |

Fig. 4

IMAGE HEATING APPARATUS

FIELD OF THE INVENTION AND RELATED ART

The present invention relates to an image heating apparatus usable with an image forming apparatus such as an electrophotographic type copying machine, printer or facsimile machine. As the image heating apparatus, there are a fixing device for fixing an unfixed image formed on a recording material, a glossiness treatment heating apparatus for improving a glossiness of the image by heating the image fixed on the recording material and so on.

As for a toner fixing device for the electrophotographic type apparatus, there are known heating roller type, film heating type or the like devices. They are recently further improved to shorten the first copy time, to speed up, or to save power. For example, a heating unit is provided on an outer surface of the fixing roller by which only the outer surface thereof is heated (outer addition heat fixing type).

By heating only the outer surface of the fixing roller, the time required to heat the fixing roller up to a predetermined temperature, and simultaneously to save the electric energy consumption. The external heating fixing type fixing devices are generally classified into a contact type in which the heating unit is contacted to the outer surface of the fixing roller, and a non-contact type in which the outer surface of the fixing roller is heated by a non-contacted halogen heater or the like. In the contact type, a heat transfer efficiency is higher than in the non-contact type, since a heat source such as a ceramic heater directly transfer the heat to the fixing roller.

The contact type is further classified into a sliding contact type in which a heater is in sliding contact directly to the outer surface of the fixing roller, and a rotation contact type in which a heating rotatable member provided around a heater is contacted to the fixing roller. In the rotation contact type, the heating rotatable member enclosing the heater rotates together with the movement of the surface of the fixing roller, and therefore, the fixing roller is less damaged as compared with the sliding contact type; and the frictional force is small, and therefore, the required driving torque can be saved. On the other hand, when the toner is fixed on the recording paper, a small amount of contaminant such as the toner or paper dust may be deposited on the fixing member such as the fixing roller, a pressing roller or the like.

Most of the toner and the paper dust deposited on the surface of the fixing member is transferred onto the recording paper (the amount is so small that it is not remarkable), and therefore, the amount of the toner and the paper dust accumulating on the surface of the fixing member is small. In the contact type outer heat-fixing device, however, the heating unit contacts the outer surface of the fixing roller, the contaminant may transfer onto the heating unit from the fixing roller.

No recording material such as the recording paper passes through the contact portion between the fixing roller and the heating unit in the external heating fixing type, and therefore, the contaminant once deposited on the heating unit is hardly removed therefrom. With the repetition of the fixing operation, the contaminant may be accumulated even to such an extent that the amount of the heat transfer from the heater to the outer surface of the fixing roller decreases. If this occurs, the fusing of the toner becomes insufficient with the result of deterioration of the fixing property (improper fixing), and a mass of the contaminant suddenly separates from the heating unit with the result of contamination of the print of the paper (image defect).

In the case of the sliding contact type, the heater slides on the outer surface of the fixing roller, and therefore, the contaminant is scraped by the heater and accumulates on the heater. For this reason, Japanese Laid-open Patent Application 2003-186327 proposes that a cleaning web is provided between the heater and the fixing roller in order to prevent accumulation of the contaminant on the heater. Japanese Laid-open Patent Application 2005-250453 discloses a cleaning mode operation in which the contaminant of the heater is ejected by switching a rotational direction of the fixing roller.

On the other hand, in the case of the rotation contact type, the contaminant deposited on the surface of the fixing roller is less scraped by the heating rotatable member, and therefore, the contaminant is less accumulated on the heating rotatable member. However, with repetition of the fixing operation, the contaminant may be accumulated on the surface of the heating rotatable member also in the outer heat-fixing device of the rotation contact type.

SUMMARY OF THE INVENTION

Accordingly, it is a principal object of the present invention to provide an image heating apparatus of the rotation contact and external heating type, in which accumulation of the contaminant on the heating rotatable member is prevented, so that an improper fixing attributable to the contaminant of the heating rotatable member and an image defect attributable to discharge of the contaminant are avoided.

It is another object of the present invention to provide an image heating apparatus for heating a toner image formed on a recording material, comprising: a first rotatable member contactable to the toner image; a heating unit, including a second rotatable member rotating while contacting a surface of the first rotatable member, for heating said first rotatable member; wherein the toner image on the recording material is heated by receiving heat from the first rotatable member heated by the heating unit, and a potential controller for maintaining a polarity of a surface potential of the second rotatable member so as to be opposite to a charge polarity of the toner.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 4 illustrates a polarity and a relation of the surface potential of the fixing member in a third embodiment of the present invention.

DESCRIPTION OF THE PREFERRED EMBODIMENTS

First Embodiment (Image Forming Apparatus)

Figure 9:
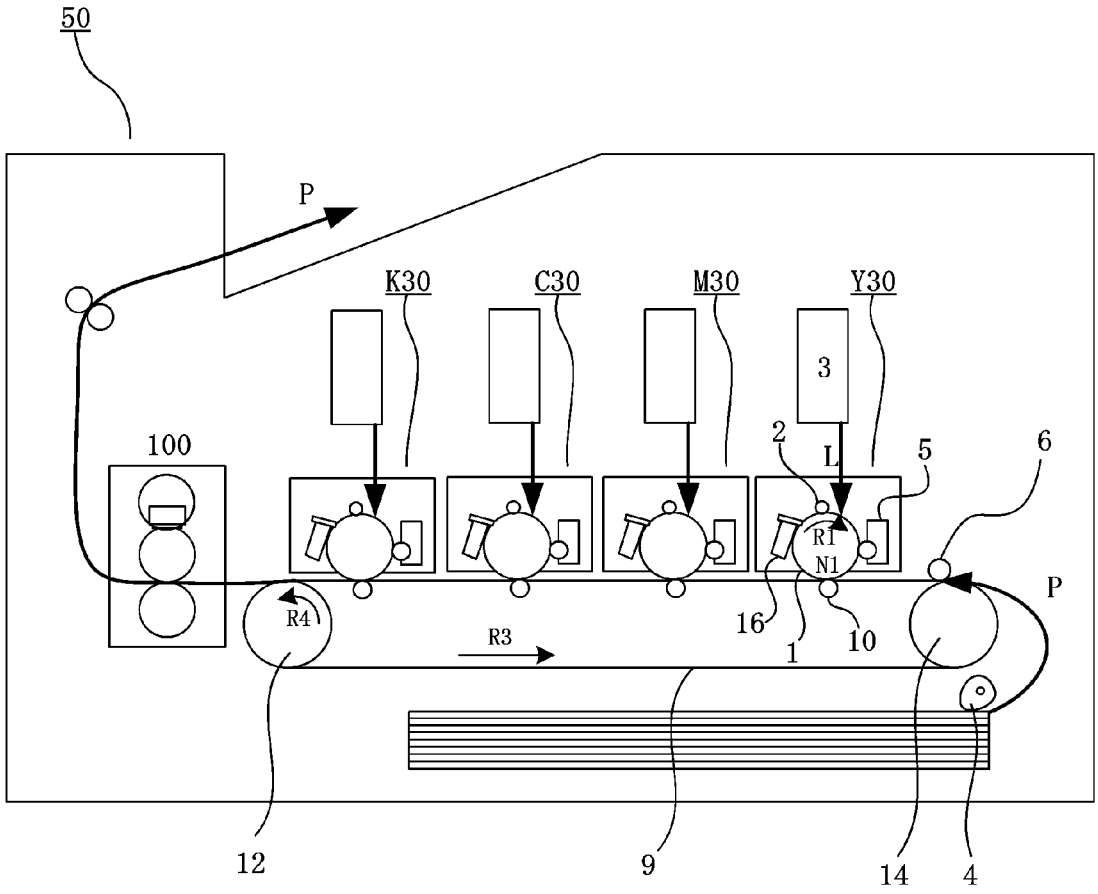
FIG. 9 is a sectional view illustrating a general arrangement of the entirety image forming apparatus.

Referring first to FIG. 9, an example of an image forming apparatus for forming a toner image on a recording material will be described. In an image forming apparatus 50 of this embodiment, yellow, magenta, cyan and black (four colors) toner images are sequentially transferred onto a recording material P carried on a recording material feeding belt 9.

Around a peripheral surface of a photosensitive drum 1 as an image bearing member, there are provided a charger 2, an exposure device 3 for exposing the photosensitive drum 1 with a laser beam, a developing device 5, a transfer roller 10 through a recording material feeding belt 9, and a photosensitive drum cleaner 16 in this order along a rotational moving direction (arrow R1). In operation, first, a surface of the photosensitive drum 1 is charged to the negative polarity by the charger 2. The charged photosensitive drum 1 is exposed to the beam L by the exposure means 3 so that an electrostatic latent image is formed on the surface of the photosensitive drum 1 (the exposed portion has a high surface potential).

In this embodiment, each color toner has been charged to the negative polarity, the developing device 5 containing yellow toner (first color) deposits the negative toner only to the electrostatic latent image portion (negative potential) on the drum 1 using a potential difference. By this, a yellow toner image is formed on the drum 1. On the other hand, the recording material feeding belt 9 is supported by two supporting shafts (driving roller 12 and tension roller 14), and is rotated in a direction indicated by an arrow R3 by the driving roller 12 rotating in the direction indicated by an arrow R4 in the Figure. The recording material P is fed by sheet feeding rollers 4, and is electrostatically attracted onto the recording material feeding belt 9 which is charging by an attraction roller 6 supplied with a positive polarity bias voltage, and is fed by the rotation of the recording material feeding belt 9.

When the recording material P is fed to a transfer nip N1, the transfer roller 10 (transfer portion) rotated by the recording material feeding belt 9 is supplied with a positive polarity transfer bias voltage which is opposite the polarity of the toner from an unshown voltage source. Yellow toner image on the drum 1 is transferred onto the recording material P in a transfer nip N1. The drum 1 after the transfer is cleaned by the photosensitive drum cleaner 16 having an elastic blade so that untransferred toner is removed from the surface of the drum 1.

The series of image forming process including the charging, exposure, development, transfer and cleaning steps is carried out for the yellow Y30 (first color) the magenta (second color), cyan C30 (third color) and black K30 (fourth color) using respective developing cartridges. By doing so, a four color toner image is formed on the recording material P on the recording material feeding belt 9. The recording material P now carrying the four color images (unfixed toner image) is fed to a fixing device 100, where the toner image is fixed by a fixing device as the image heating apparatus.

(Fixing Device)

Figure 1:
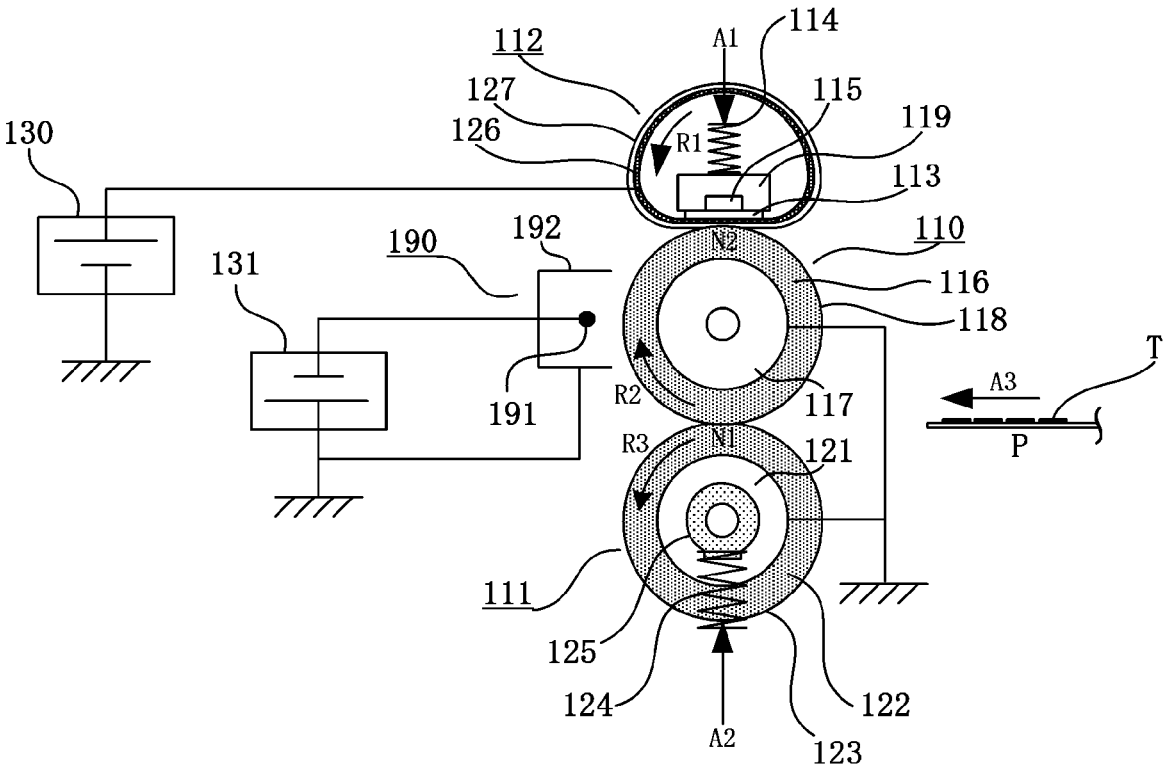
FIG. 1 is a schematic view of a fixing device using a bias applying voltage source as a potential controller.

Referring to FIG. 1, the fixing device 100 of this embodiment will be described. The fixing device 100 of this embodiment is a rotation contact type outer heat-fixing device which is advantageous in the first copy time and power saving. To an outer surface of a fixing roller 110 which is a first rotatable member, a pressing roller 111 (pressing member) which is a back-up member is opposed to form a fixing nip N1. On the other hand, a heating unit is press-contacted to the outer surface of the fixing roller 110 to establish a contact heating portion N2.

The heating unit includes a heating rotatable member (second rotatable member) 112 and a heater 113 contacting to an inner surface of the heating rotatable member 112. The heater 113 contained in heating rotatable member 112 heats the surface of the fixing roller 110 by the contact heating portion N2. The thermal energy from the heating unit as the outer heating means is applied to the toner image on the recording material P through the fixing roller 110. Thus, when the recording material P carrying the unfixed toner image T is fed to the fixing nip N1, the heat of the surface of the fixing roller 110 is transferred to the unfixed toner image T and to the recording material P so that the toner image T is fixed on the surface of the recording material P.

(Fixing Roller)

The fixing roller 110 has an outer diameter of ϕ20 mm, and comprises a core metal of steel having an outer diameter of ϕ12 mm which is grounded, and an elastic layer (foam silicone rubber) having a thickness of 4 mm outside the core metal 117. If a thermal capacity and a thermal conductivity of the fixing roller 110 are large, a large amount of the heat received from the outer surface is absorbed into the fixing roller 110, and therefore a surface temperature increase is slow. Therefore, a low thermal capacity, a low thermal conductivity and a high heat insulation effect are desirable for the quick rise of the surface temperature of the fixing roller 110.

The silicone rubber foam has a thermal conductivity of 0.11-0.16 W/m K which is smaller than that of a solid rubber having a thermal conductivity of approx. 0.25-0.29 W/m K. A specific gravity thereof is concerned with the thermal capacity, and that of solid rubber is approx. 1.05-1.30, but that of the foam rubber is approx. 0.75-0.85, that is, it has a low thermal capacity. Therefore, the foam rubber is effective to reduce the time required for the rise of the surface temperature of the fixing roller 110. From the standpoint of reducing the thermal capacity, a small outer diameter of the fixing roller 110 is desirable, but if it is too small, a width of the contact heating portion N2 becomes small, and therefore, a proper diameter is to be used.

In this embodiment, the outer diameter thereof is ϕ20 mm. As for a thickness of the elastic layer 116, if it is too small, the heat is wasted into the core metal, and therefore, a proper thickness is required, and in this embodiment, it is 4 mm. On the elastic layer 116, a parting layer 118 of tetrafluoroethylene-perfluoroalkyl vinyl ether copolymer (PFA) is provided. The parting layer 118 may be in the form of a coating tube, or may be applied on the surface, and in this embodiment, it is in the form of a tube which is good in a durability.

The material of the parting layer 118 but this is not limited to the PFA, and may be a fluorinated resin material such as polytetrafluoroethylene resin material (PTFE), tetrafluoroethylene-hexafluoropropylene resin material (FEP), fluorine-containing rubber, silicone rubber or the like which has a high parting property. From the standpoint of providing a wider contact heating portion N1, a low surface hardness of the fixing roller 110 is preferable, but if it is too low, the durable is not enough, and in this embodiment, it is 40-45° (Asker-C hardness with 4.9 N load). The fixing roller 110 is rotated at a surface moving speed of 60 mm/sec in the direction of an arrow R2 in the Figure by unshown rotating means.

(Pressing Roller)

A pressing roller 111 preferably has a low thermal capacity and a low thermal conductivity since then it does not take the heat from the fixing roller 110 very much, and in this embodiment, it has the same structure as the fixing roller 110. It has an outer diameter of ϕ20 mm, and comprises a grounded steel core metal 121 having a diameter of ϕ12 mm, an elastic foam rubber layer 122 having thickness of 4 mm outside the core metal, and a parting layer 123 which is an outermost surface layer of PFA.

The pressing roller 111 is pressed in the direction of an arrow A2 in the Figure through bearings 125 by a pressing roller urging spring 124 to form a fixing nip N1 of a width 7 mm, and is rotated by the fixing roller 110 (arrow R3 in the Figure).

(Heating Rotatable Member)

In this embodiment, the heater 113 is held by a heater holder 119, and around the heater 113, the heating film 112 (endless belt member) as the heating rotatable member is provided. The heater holder 119 is pressed with a force of 147 N in the direction of an arrow A1 in the Figure by the urging spring 114, it is pressed toward the fixing roller 110 through the heating film 112 to form a heating nip N2 having a width of 7.5 mm.

The heating film 112 receives a force by a rotating fixing roller 110 in the direction of an arrow R2 in the Figure at the heating nip N2 to rotate in the direction of the arrow R1.

The heating film 112 which is the heating rotatable member comprises a plurality of layers in the radial direction, more particularly a base layer 126 for assuring the strength of the film and a parting layer 127 for suppressing deposition of the contaminant to the surface. At least one of an innermost layer and an outermost lay is an electroconductive layer to which bias voltage is applied. The material of the base layer 126 has to have a heat resistive since it receives the heat from the heater 113, and has to have a strength since it slides on the heater 113. Therefore, the material thereof is preferably a metal such as SUS (stainless used steel) or a heat resistive resin material such as polyimide.

The metal has a higher strength than resin material, and therefore, the thickness may be smaller, and it has a high thermal conductivity, and therefore, the heat transfer from the heater 113 to the fixing roller 110 is good. The resin material has a smaller density, and therefore, smaller thermal capacity which means easy to heat. The resin material is easy to form into thin film by a paint molding, and therefore, the manufacturing cost is low. In this embodiment, the base layer 126 of the heating film 112 is made of polyimide resin material, in which carbon filler is added to improve the thermal conductivity and the electroconductivity.

From the standpoint of heat transmission from the heater 113 to the surface of the fixing roller 110, the thickness of the base layer 126 is preferably small, but the small thickness results in the low strength, and therefore, it is preferably approx. 20 μm-100 μm, and in this embodiment it is 60 μm. Similarly to the parting layer of the pressing roller 111, the material of the parting layer of the heating film 112 is preferably fluorinated resin material such as PFA, PTFE, FEP having a high parting property, and in this embodiment, PFA is used since it is good both in the parting property and the heat resistive. From the standpoint of heat transmission from the heater 113 to the fixing roller 110, the parting layer 127 is preferably thin, and therefore, it is preferably approx. 1 μm-20 μm, and in this embodiment, it is 10 μm.

(Polarity of Contamination Deposited on Heating Rotatable Member)

As described above, when the toner image T on the recording material P is fixed, on the fixing roller 110 contacting the recording material P and the toner image T, contamination (such as paper dust) of the recording material or contamination of a mixture of the recording material contamination with toner contamination is deposited in a slight amount.

This contamination such as paper dust is liable to generate for the recording material containing particularly calcium carbonate in a large amount. The recording material can be napped when being slid at a sheet feeding portion or a sheet conveying portion of the image forming apparatus, so that fibers of the recording material are liable to be separated. When the recording material is conveyed to the fixing nip N1 to contact the fixing roller 110, the fibers of the recording material can be deposited on the fixing roller 110.

When calcium carbonate is contained in a large amount in the recording material, powder of calcium carbonate is liable to transfer onto the fixing roller together with the recording material fibers, so that paper dust contamination consisting of the recording material fibers and the calcium carbonate powder is liable to generate. In some cases, the contamination such as the toner and the paper dust deposited on the fixing roller 110 is partly transferred onto the heating film 112 at the heating nip N2. When the fixing of the toner image on the recording material P is repeated, the contamination of the heating film is accumulated. With respect to this contamination accumulated on the heating film 112 was checked.

Figure 2:
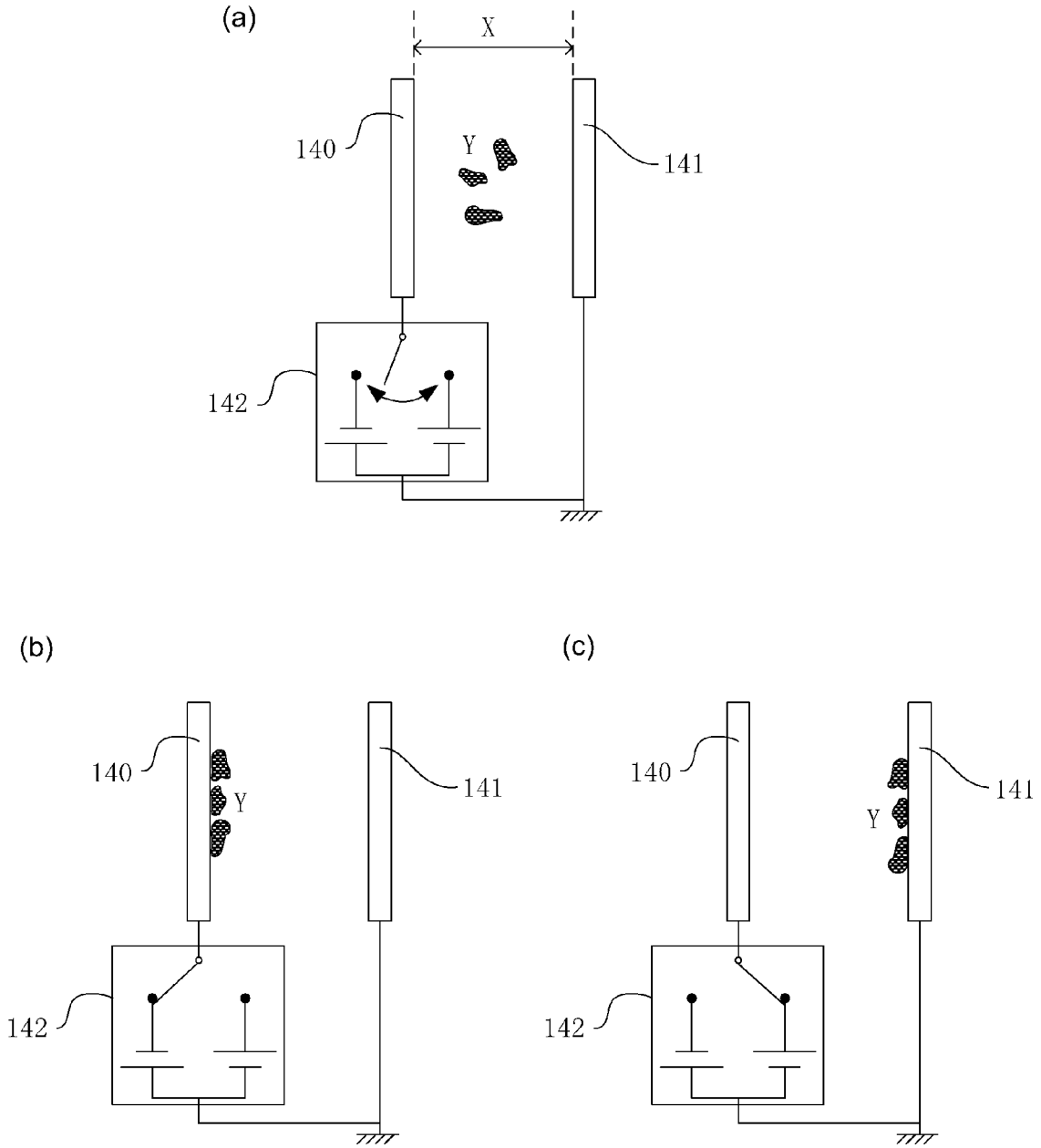
FIG. 2, (a) illustrates an apparatus provided with an electrode plate for detecting a polarity of the contaminant deposited on a heating rotatable member, and (b) shows a case in which the electrode plate is supplied with a negative potential, and (c) shows a case in which the electrode plate is supplied with a positive potential.

A checking method of the polarity of the contamination is shown (a) to (c) of FIG. 2. As shown in (a) of FIG. 12, contamination Y taken from the surface of the heating film 112 was placed between a pole plate 140 to be supplied with a bias and a pole plate 141 which was grounded and then the bias was applied to the pole plate 140 by a high voltage source 142 capable of switching the positive polarity (+) and the negative polarity (−). A pole plate distance X between the pole plates 140 and 141 was 20 mm, and motion of the contamination Y between the pole plates when the bias of ±500 V was applied to the pole plate 140 by the high voltage source 142 was observed.

Part (b) of FIG. 2 is a schematic view when the bias of −500 V is applied to the pole plate 140, and (c) of FIG. 2 is a schematic view when the bias of +500 V is applied to the pole plate 140. When the bias of −500 V was applied to the pole plate 140, the contamination Y was moved to the pole plate 140, and then when the bias of +500 V was applied to the pole plate 140, the contamination Y was moved from the pole plate 140 to the pole plate 141. It was found that the contamination Y is attracted by the negative (−) bias and is repelled by the positive (+) bias. This means that the contamination Y has the positive polarity. The paper dust contamination deposited on the fixing roller 110 is generated from the recording material P which is positively charged by the positive bias applied during the transfer and therefore has the positive polarity.

On the other hand, the toner contamination deposited on the fixing roller 110 basically has the negative polarity. However, the toner transferred from the recording material P onto the fixing roller 110 and deposited on the fixing roller 110 during the fixing is considered as being the toner with weak positive polarity or the toner reversed in polarity to the positive polarity for the following reason.

That is, the toner image transferred from the photosensitive drum 1 onto the recording material P basically has the negative polarity and is electrostatically deposited on the recording material which is positively charged. However, the transfer of the toner contamination from the recording material P onto the fixing roller 110 when the recording material P passes through the fixing nip N1 means that the toner contamination is transferred in the case where the depositing force on the fixing roller 110 is stronger than the electrostatic depositing force on the recording material P. For this reason, the toner deposited on the fixing roller 110 to constitute the toner contamination is considered to be the toner with the weak negative polarity or the toner reversed in polarity to the positive polarity during the transfer.

The contamination Y deposited on the heating rotatable member is the mixture of the paper dust contamination with the positive polarity with the toner with the weak negative polarity or the toner with the positive polarity and thus has the positive polarity opposite to the normal charge polarity of the toner and is deposited.

(Relationship Between Contamination on Heating Rotatable Member and Surface Potential of Heating Rotatable Member or Fixing Roller)

Next, the surface potential of the heating rotatable member which is a characteristic feature of the present invention will be described. In the present invention, the surface potential of the heating rotatable member is controlled so that the surface potential of the heating rotatable member has the polarity opposite to the normal charge polarity of the toner (negative (−) in this embodiment). As described above, the polarity of the contamination deposited on the heating rotatable member surface is opposite to the normal charge polarity of the toner and therefore the polarity of the heating rotatable member surface is made identical to the polarity of the contamination, so that the deposition of the contamination is suppressed. The polarity of the toner in this embodiment is negative and therefore in this embodiment, the surface potential of the heating rotatable member is controlled at the positive polarity opposite to the polarity of the toner.

The base layer 126 of the heating film 112 which is the heating rotatable member in this embodiment is electroconductive and thus by applying the positive bias from an external high voltage source 130 to this electroconductive base layer 126, the surface potential of the heating film 112 is controlled at the positive polarity. At a terminal of the external high voltage source 130, an electroconductive resin portion provided with electroconductivity by adding carbon black into PI material similar to the material for the base layer 126. This electroconductive resin portion constitutes a sliding contact, to which the bias is applied from the external high voltage source 130, while sliding on the base layer 126 located inside the heating film 112. In the case where the bias is applied from the external high voltage source 130 to the base layer 126, the surface potential of the heating film 112 is the same as the potential of the external high voltage source 130.

On the other hand, in this embodiment, also the surface potential of the fixing roller 110 is controlled. The surface potential of the fixing roller 110 is controlled at the negative polarity opposite to the positive polarity of the heating film 112 by a non-contact charging device 190, so that the direction of the electric field is changed from the heating film 112 as the heating rotatable member to the fixing roller 110. The non-contact charging device 190 is a general corona charger and includes a charging wire 191, to which the negative bias is applied from an external high voltage source 131, and a shield 192 which is grounded, and charges the parting layer 118 as the surface layer of the fixing roller 110 to the negative polarity in a non-contact manner.

Here, a checking result of the contamination deposited on the heating film 112 when the surface potentials of the heating film 112 and the fixing roller 110 are changed is shown below.

The contamination checking of the heating film 112 was performed by using the recording material containing calcium carbonate in 20 wt. % or more as the recording material liable to cause the paper dust contamination in order to accelerate the checking. Then, the contamination of the heating film 112 at the time when 500 sheets of this recording material were subjected to a durability printing test was relatively compared.

A print pattern was a halftone print pattern used as a pattern liable to cause the toner on the recording material to be deposited (offset) on the fixing roller 110 in the fixing nip N1. The surface potentials of the heating film 112 and the fixing roller 110 were changed to +500 V, +250 V<±0 V, −250 V and −500 V by unshown high voltage sources, respectively. The contamination of the heating film 112 when the durability printing test on 500 sheets was conducted was compared.

A comparison result of the heating film contamination is shown in Table 1.

TABLE 1

| | Heating film surface potential | | | | |
|---|---|---|---|---|---|
| FRSP*[1] | +500 V | +250 V | ±0 V | −250 V | −500 V |
| +500 V | 6 (±0 V) | 4 (−250 V) | 3 (−500 V) | 2 (−750 V) | 1 (−1000 V) |
| +250 V | 7 (+250 V) | 6 (0 V) | 4 (−250 V) | 3 (−500 V) | 2 (−750 V) |
| +0 V | 8 (+500 V) | 7 (+250 V) | 5 (±0 V) | 4 (−250 V) | 3 (−500 V) |
| −250 V | 9 (+750 V) | 8 (+500 V) | 7 (+250 V) | 6 (±0 V) | 4 (−250 V) |
| −500 V | 10 (+1000 V) | 8 (+750 V) | 7 (+500 V) | 6 (+250 V) | 5 (±0 V) |

*[1]"FRSP" represents the fixing roller surface potential.

Evaluation of the contamination is performed at ten levels from "1" to "10". The level "1" represents that the heating film is most contaminated. The contamination level is alleviated with an increase of the number of levels, and the level "10" represents that the heating film is least contaminated. Further, values in parentheses in Table are potential differences between the heating film and the fixing roller ((heating film surface potential)−(fixing roller surface potential)). "+" represents that the direction of the electric field is from the heating film to the fixing roller. Tendency of the heating film contamination is such that even in the case where the fixing roller has any surface potential, the level of the heating film contamination is improved when the heating film surface potential is positive.

This is because when the heating film surface potential is directed to the positive polarity, the direction and intensity of the electric field are directed from the heating film toward the fixing roller and the contamination with the positive polarity receives an electrostatic force from the heating film toward the fixing roller and therefore the contamination with the positive polarity is not readily deposited on the heating film. On the other hand, the fixing roller surface potential tends, in the case where the fixing roller has any surface potential, to improve the heating film contamination level when the fixing roller surface potential is directed toward the negative polarity. This is also because the fixing roller surface potential is directed to the negative polarity, the direction and intensity of the electric field are directed from the heating film toward the fixing roller and the contamination with the positive polarity receives the electrostatic force from the heating film toward the fixing roller and therefore the contamination with the positive polarity is not readily deposited on the heating film.

((Heating Film Surface Potential)−(Fixing Roller Surface Potential))

The potential difference of ((heating film surface potential)−(fixing roller surface potential)), i.e., the electric field intensity (strength) from the heating film toward the fixing roller increases the electrostatic force acting on the positive polarity contamination with an increase thereof and therefore the positive polarity contamination is not readily deposited on the surface of the heating film 112. However, when the electric field intensity is excessively large, there is the case where electric discharge occurs between the heating film and the fixing roller and there is a possibility of an occurrence of current leakage. Therefore, the positive polarity of ((heating film surface potential)−(fixing roller surface potential)) may preferably be about +100 V to about +3 kV.

In this embodiment, as an example, the surface potential of the heating film 112 is controlled at +500 V opposite in polarity to the toner charge polarity, and the surface potential of the fixing roller 110 is controlled at −500 V (negative polarity), so that the potential difference therebetween is +1 kV.

(Effect of this Embodiment)

The constitution in this embodiment in which the surface potential of the heating film 112 is +500 V opposite in polarity to the toner charge polarity and the surface potential of the fixing roller 110 is −500 was compared with a constitution in a comparative embodiment. In the comparative embodiment, the external high voltage sources 130 and 131 are turned off, so that the surface potential difference between the heating film 112 and the fixing roller 110 is 0 V (=(heating film surface potential)−(fixing roller surface potential)). Further, a durability printing test was conducted to make comparison of the contamination of the heating film 112. The comparison of the contamination was made in the following manner. In each constitution, the durability printing test was conducted until $100\times10^3$ sheets which was two times the lifetime of the fixing device 100 and then an occurrence of improper fixing due to the heating film contamination and an occurrence of image defect due to discharge of the contamination were checked.

A fixing property is represented by a density lowering ratio calculated in the following manner. A measuring device used is Macbeth reflection densitometer ("RD914"). On a halftone image fixed on the paper, 5 sheets of lens-cleaning paper are superposed and then slide by 5 reciprocation under a load of 0.4 N/cm$^2$. Densities before and after the sliding are measured. In this embodiment, a density D1 before the sliding was about 0.7 as the halftone density. When the density after the sliding is D2, the density lowering ratio is calculated by: ((D1−D2)/D1)×100(%).

At each of times of $5\times10^3$ sheets, $10\times10^3$ sheets, $25\times10^3$ sheets, $50\times10^3$ sheets, $75\times10^3$ sheets and $100\times10^3$ sheets in the durability printing test, the halftone black image was printed and subjected to the measurement of the density lowering ratio to evaluate the fixing property. The fixing property was evaluated as "o" (good fixing property) when the density lowering ratio was less than 10%, "Δ" when the density lowering ratio was 10% or more and less than 20%, and "x" (improper fixing) when the density lowering ratio of 20% or more. Further, the fixing property evaluation criterion varies depending on the specification of the apparatus and therefore a necessary fixing property can be appropriately determined for the apparatus used.

The image defect due to the heating film contamination discharge was evaluated as "o" when there was no image defect and "x" when the image defect occurred. The results are shown in Table 2.

TABLE 2

| Surface potential*1 | | P.N*2 (sheets) 5000 | 10000 | 25000 | 50000 | 75000 | 100000 |
|---|---|---|---|---|---|---|---|
| TEC | FP*3 | ○ | ○ | ○ | ○ | ○ | ○ |
| | ID*4 | ○ | ○ | ○ | ○ | ○ | ○ |
| 0 V | FP | ○ | Δ | Δ | x | x | x |
| | ID | ○ | ○ | ○ | x | x | x |

*1"Surface potential" represents the surface potentials of the heating film and the fixing roller. "TEC" represents the constitution in this embodiment in which the heating film surface potential is +500 V and the fixing roller surface potential is −500 V. "0 V" represents the constitution in the comparative embodiment in which both of the heating film surface potential and the fixing roller surface potential are 0 V.

*2"P.N" represents the print number (sheets).

*3"FP" represents the fixing property.

*4"ID" represents the first defect.

In the constitution in this embodiment in which the surface potential of the heating film 112 was +500 V opposite in polarity to the toner charge polarity and the surface potential of the fixing roller 110 was −500 V, there were no occurrences of the improper fixing and the image defect due to the contamination discharge until $100\times10^3$ sheets which are two times the lifetime of the fixing device. On the other hand, in the case of the constitution in the comparative embodiment in which the surface potentials of the heating film 112 and the fixing roller 110 are 0 V, the lowering in fixing property due to the contamination of the heating film 112 was observed from $10\times10^3$ sheets, and after $50\times10^3$ sheets, and after $50\times10^3$ sheets, the improper fixing and the contamination discharge to the image (image defect) were confirmed.

With respect to the contamination deposited on the heating film 112, the deposition of the contamination on the heating film 112 can be suppressed by controlling the surface potential of the heating film 112 so as to be opposite to the toner charge polarity since the heating film surface potential has the same polarity as that of the transfer bias which is opposite in polarity to the toner charge polarity as described above. Further, by controlling the surface potentials of the heating film 112 and the fixing roller 110, the potential difference is provided with respect to the direction in which the contamination is moved from the heating film to the fixing roller, so that it is possible to further prevent the deposition of the contamination on the heating film 112.

Second Embodiment

In this embodiment, not only the contamination deposition on the heating rotatable member but also the contamination deposition on the pressing member are suppressed. The image forming apparatus for forming the unfixed toner image is general similarly as in First Embodiment and therefore will be omitted from description. Further, a basic constitution of the fixing device is the same as that in First Embodiment and is the external heat-fixing device of the rotation contact type. The same members or portions are represented by the same reference numerals or symbols and will be omitted from description. In this embodiment, in addition to the constitution similarly as in First Embodiment in which the fixing roller surface potential is controlled so that the toner receives the force from the fixing roller toward the heating rotatable member, the pressing member surface potential is also controlled so that the toner receives the force from the fixing roller toward the heating rotatable member.

(Pressing Member Surface Potential and Electric Field Direction)

In the external heat-fixing device of the rotation contact type, as described above, the contamination can be deposited on the heating rotatable member and also on the pressing member. When the toner image on the recording material P is fixed in the fixing nip N1 as described above, the contamination such as the toner and paper dust is deposited in a slight amount on the fixing roller 110 contacting the recording material P and the toner image T. The contamination deposited on the fixing roller 110 reaches the heating nip N2.

However, the surface potential of the heating rotatable member is made opposite in polarity to the toner charge polarity, so that the contamination with the contamination with the polarity opposite to the charge polarity of the toner deposited on the fixing roller 110 is not readily transferred onto the heating rotatable member at the heating nip N2. Then, almost all of the toner passes through the heating nip N2 while deposited on the surface of the fixing roller 110. When the contamination with the polarity opposite to the charge polarity of the toner deposited on the fixing roller 110 reaches the fixing nip N1 again, the toner can be partly transferred onto the pressing member in the fixing nip N1. Thus, when the fixing of the toner image T on the recording material P is repeated, there is a possibility that the contamination is accumulated on the pressing member.

In this embodiment, similarly as in First Embodiment, the potential difference between the surface potentials of the heating rotatable member and the fixing roller is provided with respect to the direction in which the contamination with the polarity to the toner charge polarity receives the force from the heating rotatable member to the fixing roller, so that the contamination of the heating rotatable member is suppressed. In addition, the deposit between the surface potentials of the pressing member and the fixing roller is provided with respect to the direction in which the contamination with the polarity to the toner charge polarity receives the force from the pressing member to the fixing roller, so that the deposition of the contamination on the pressing member is suppressed.

Figure 3:
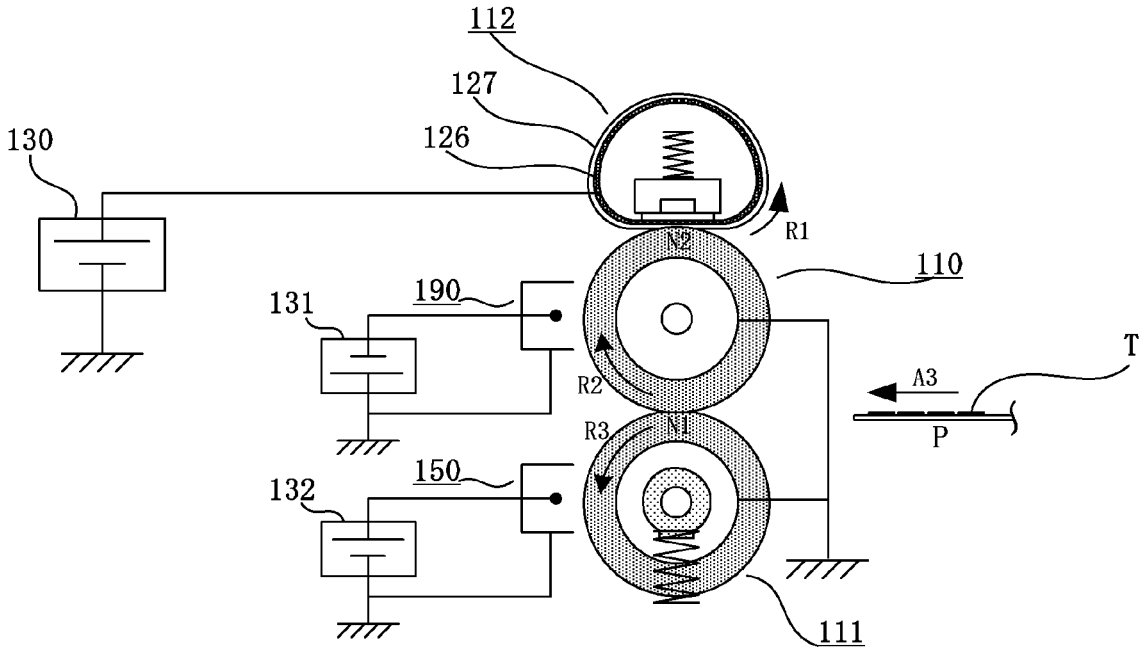
FIG. 3 is a schematic view of a fixing device according to a second embodiment of the present invention.

A schematic view of the fixing device in this embodiment is shown in FIG. 3. A basic constitution of the fixing device in this embodiment is the same as that in First Embodiment and will be omitted from description. Similarly as in First Embodiment, in order to suppress the deposition of the contamination with the polarity (positive polarity) opposite to the toner charge polarity on the surface of the heating film 112, the surface potential of the heating film 112 is suppressed so as to be the positive polarity by the external high voltage source 130. Further, the surface potential of the fixing roller 110 is controlled so that the electric field is directed from the heating film 112 to the fixing roller 110.

In this embodiment, further, the direction of the electric field is controlled so as to be directed from the heating film 112 to the fixing roller 110 so that the positive polarity contamination is not readily deposited on the surface of the pressing roller 111 which is the pressing member. For directing the electric field direction from the heating film 112 to the fixing roller 110 and from the pressing roller 111 to the fixing roller 110 while controlling the polarity of the surface potential of the heating film 112 so as to be opposite to the toner charge polarity, there are three methods as shown in A, B and C in FIG. 4.

The method A is such that all the polarities of the surface potentials of the heating film 112, the fixing roller 110 and the fixing member of the pressing roller 111 are made opposite to the toner charge polarity and the surface potential of the fixing roller 110 is made smaller than the surface potential of the pressing roller 111. The method B is such that the surface potential of the heating film 112 is made opposite to the toner charge polarity, that the polarities of the surface potentials of the fixing roller 110 and the pressing roller 111 are made identical to the toner charge polarity and that the negative potential of the fixing roller 110 is made larger than that of the pressing roller 111.

The method C is such that the polarities of the surface potentials of the heating film 112 and the pressing roller 111 are made opposite to the toner charge polarity and the polarity of the surface potential of the fixing roller 110 is made identical to the toner charge polarity.

Even in either of the methods A, B and C, so long as the same potential difference is provided with respect to the direction in which the contamination with the polarity opposite to the toner charge polarity receives the force from the heating film to the fixing roller and the direction in which the contamination receives the force from the pressing roller to the fixing roller, suppressing effects of the contamination deposited on the heating film and the pressing roller are the same.

However, in the method C in which the surface potential polarities are different between the members contacting each other, a large potential difference can be provided even when absolute values of control biases for the respective members are small. For this reason, in this embodiment, also by using the method C, the surface potentials of the members were controlled so that the surface potentials of the heating film and the pressing roller have the positive polarity and the surface potential of the fixing roller has the negative polarity. In this embodiment, as a means for controlling the surface potential of the pressing roller 111 so as to have the polarity opposite to the toner charge polarity, similarly as a control means of the surface potential of the fixing roller 110, a non-contact charging device 150 (FIG. 3) was used.

The bias of the positive polarity opposite to the toner charge polarity is applied by the external high voltage source 132, so that the surface potential of the pressing roller 111 is charged to the positive polarity.

((Pressing Roller Surface Potential)−(Fixing Roller Surface Potential))

The potential difference of ((pressing roller surface potential)−(fixing roller surface potential)), i.e., the electric field intensity (strength) from the pressing roller toward the fixing roller increases the electrostatic force acting on the positive polarity contamination with an increase thereof and therefore the positive polarity contamination is not readily deposited on the surface of the pressing roller 111. However, when the electric field intensity is excessively large, there is, e.g., the case where electric discharge occurs between the pressing roller 111 and the fixing roller 110 and thus noise is liable to occur. Therefore, the positive polarity may preferably be about +100 V to about +3 kV.

In this embodiment, similarly as in First Embodiment, the surface potential of the heating film 112 is controlled at +500 V, the surface potential of the fixing roller 110 is controlled at −500 V, and the surface potential of the pressing roller 111 is controlled at +500 V (negative polarity). As a result, the potential difference between the surface potentials of the pressing roller 111 and the fixing roller 110 was +1 kV.

(Effect of this Embodiment)

Also in this embodiment, the durability printing (sheet passing) test similar to that in First Embodiment was conducted. In addition to the control by which the surface potential of the heating film 112 is made to have the polarity opposite to the toner charge polarity, the control of the direction of the electric field from the heating film 112 to the fixing roller 110 was effected. As a result, the heating film contamination could be suppressed, so that there was no occurrence of the image defect, until $100\times10^3$ sheets which are the lifetime of the fixing device, due to the improper fixing and the discharge of the contamination to the heating film. Further, the direction of the electric field was controlled so as to be directed from the pressing roller 111 to the fixing roller 110 and therefore it was possible to prevent also the deposition of the contamination on the pressing roller 111.

Other Embodiments (Toner Polarity)

In the above-described embodiments, the constitution in which the toner has the negative polarity and the heating rotatable member has the positive polarity opposite to the polarity of the toner is described but the present invention is similarly applicable to the case where the toner has the positive polarity by making the heating rotatable member to have the negative polarity opposite to the polarity of the toner. In this case, the polarity of the contamination is the negative polarity opposite to the toner charge polarity, so that the deposition of the contamination on the heating rotatable member is suppressed. Further, the polarities of the heating rotatable member pressing roller may be made opposite to the polarity in the above-described embodiments.

(Potential Controller)

Figure 5:
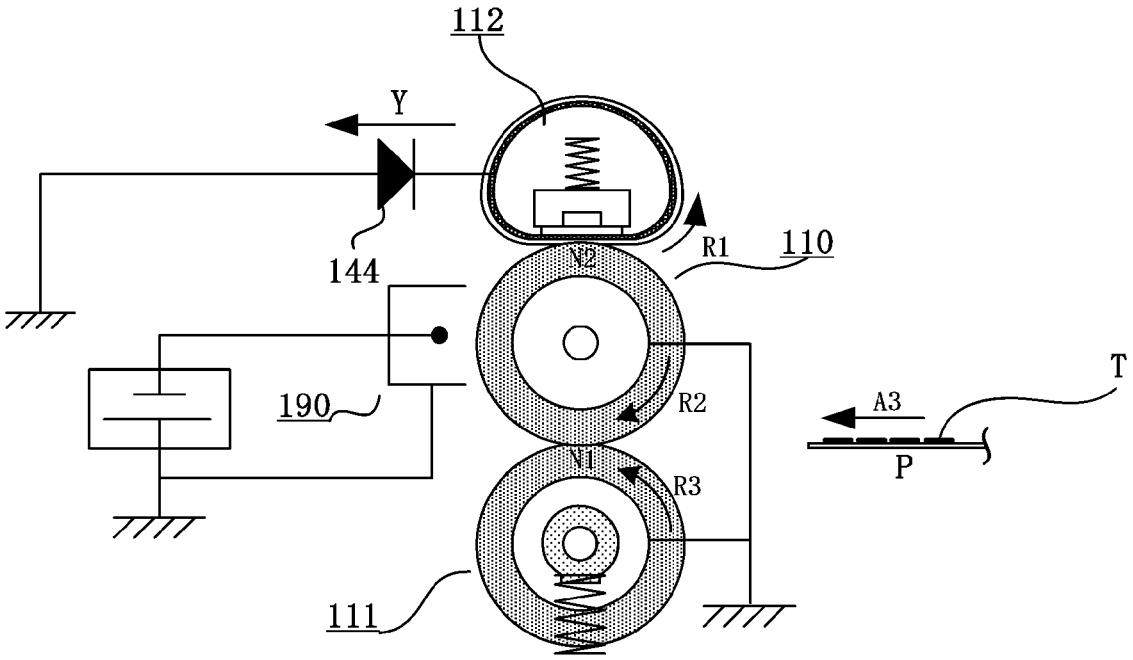
FIG. 5 is a schematic view of a fixing device using a diode as a potential controller.

As the potential controller of the surface potential of the heating rotatable member, the means for controlling the surface potential of the heating rotatable member by applying the bias from the base layer of the heating rotatable member by the external high voltage source is described but the present invention is not limited to this means. For example, as shown in FIG. 5, a diode 144 may also be provided between the heating rotatable member and the ground. The negative polarity electrons generated from the heating rotatable member 112 are moved in an arrow Y direction in FIG. 5 from N type to P type and therefore positive electric charges remain on the heating rotatable member 112, so that the surface of the surface of the heating rotatable member 112 is charged to the positive polarity. By using the diode in such a manner, the constitution of the fixing device can be simplified.

Figure 6:
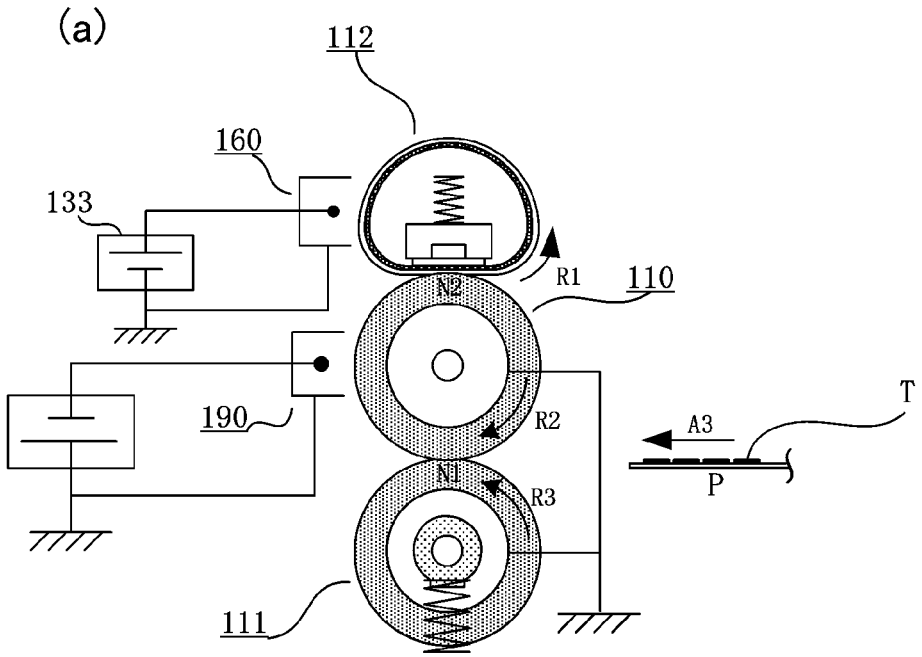
FIG. 6, (a) is an illustration of a fixing device using a non-contact type charging device as a potential controller, and (b) is an illustration of a fixing device using a contact type charging device as the potential controller.
Figure 6:
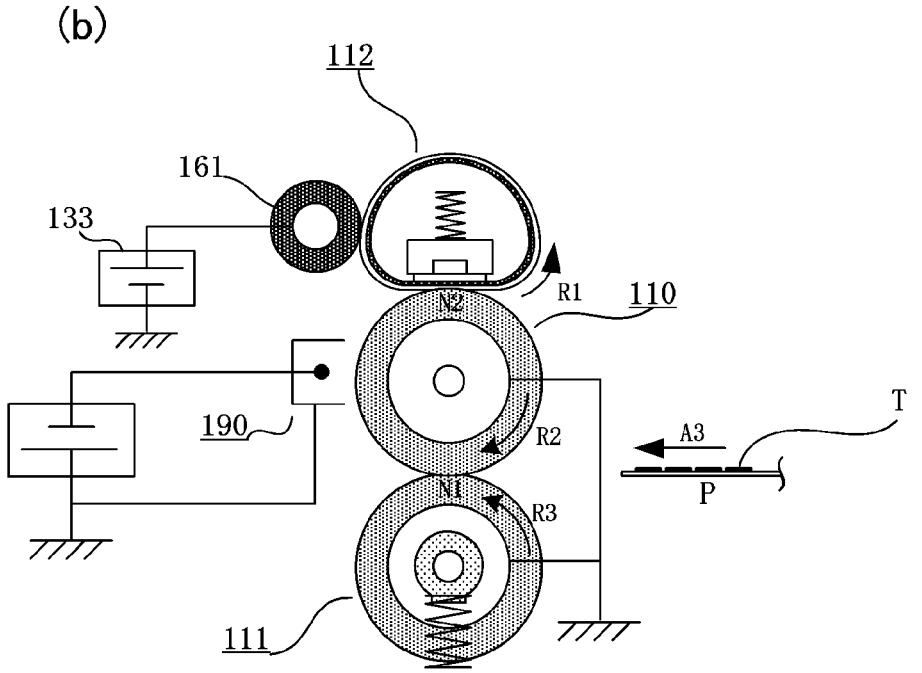

Further, as shown in FIG. 6, the surface potential polarity may also be controlled so as to be opposite to the toner charge polarity from the surface of the heating rotatable member by the charging means. Part (a) of FIG. 6 is a schematic view showing the case where the surface of the heating film 112 is charged to the polarity opposite to the toner charge polarity in a non-contact manner by using a charging device 160 of a corona charging type. On the rotating heating film 112, there is no sliding portion such as a sliding contact to which the bias is applied and therefore the heating film 112 is not damaged. Part (b) of Figure shows the case where a charging roller 161 of a contact charging type is used. The charging roller 161 is rotated by the rotation of the heating rotatable member and therefore the heating film 112 is not readily damaged similarly as in the case of (a) of FIG. 6.

By adding a carbon-based filler in the surface layer (parting layer) of the heating rotatable member to be provided with electroconductivity, the surface potential may be controlled under direct application of the bias to the heating rotatable member surface.

Incidentally, the surface potential controller in the present invention is not limited to the surface potential controller for the heating rotatable member but the above methods may also be used by employing the surface potential controller as that for the fixing roller and the pressing member.

(Heating Recording Material)

Figure 7:
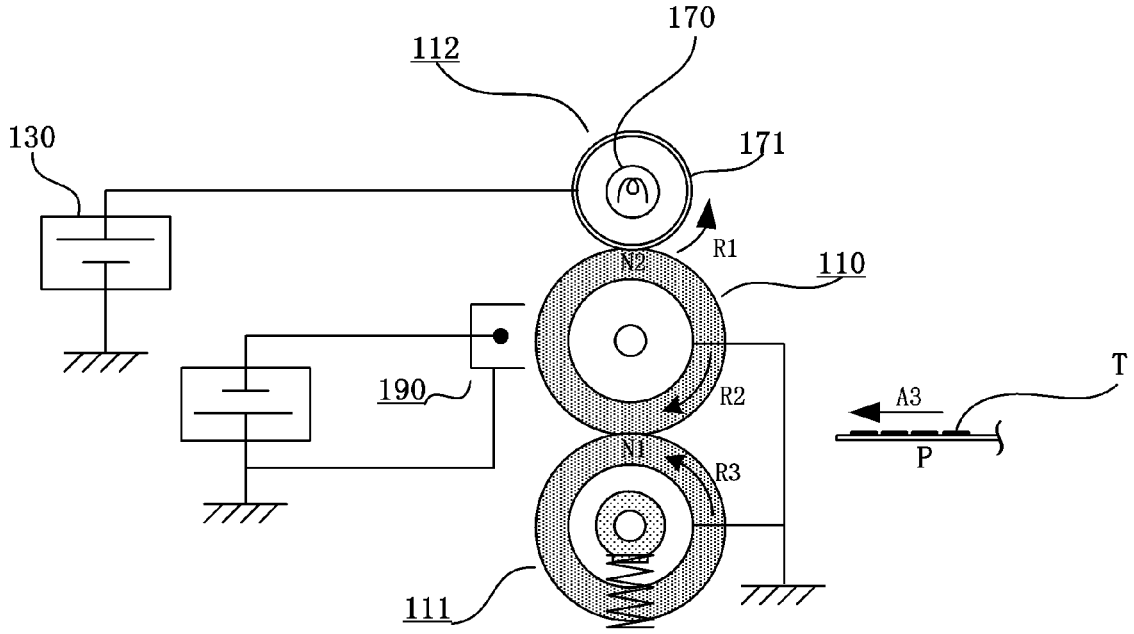
FIG. 7 is a schematic view of a fixing device including a halogen heater inside a heating rotatable member according to another embodiment of the present invention.

In First and Second Embodiments, the heating rotatable member, the fixing roller and the pressing member have the same constitution and are described but the direction is not limited to this constitution. For example, as the heating rotatable member, as shown in FIG. 7, a heating roller 171 in which a halogen heater 170 is incorporated, in place of the heater 113, at a rotation center. Also in this case, by charging the surface potential of the heating roller 171 so as to be opposite to the toner charge polarity, the deposition of the contamination to the surface of the heating roller 171 can be prevented.

(Fixing Roller)

Also with respect to the fixing roller, the insulating silicone rubber structure is described but the present invention is not limited thereto. For example, an electroconductive silicone rubber in which the carbon filler is added into the elastic layer is used, and the surface potential may also be controlled by applying the bias of the polarity opposite to the toner charge polarity from the core metal of the pressing roller by the external high voltage source or the like.

Figure 8:
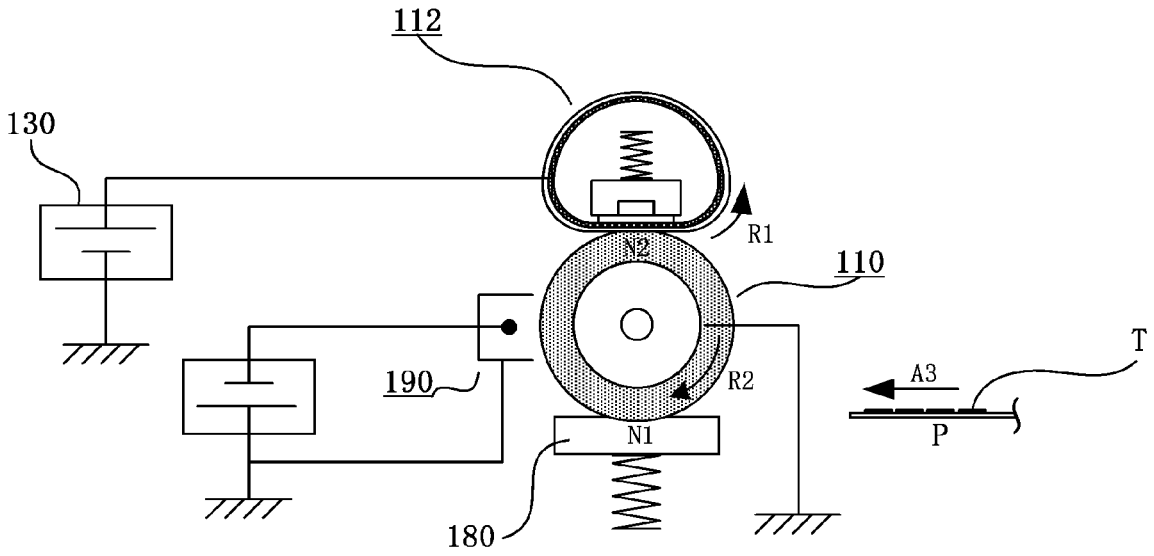
FIG. 8 is a schematic view of a fixing device using a pad as a pressing member according to a further embodiment of the present invention.

Further, as the pressing member, the constitution using the pressing roller is described but the present invention is not limited thereto. As shown in FIG. 8, the pressing member such as a non-rotational pad member 180 may also be used.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 280733/2010 filed Dec. 16, 2010, which is hereby incorporated by reference.

What is claimed is:

1. An image heating apparatus for heating a toner image formed on a recording material, comprising:

a first rotatable member contactable to the toner image;

a second rotatable member configured to form a heating nip between itself and said first rotatable member by contacting an outer surface of said first rotatable member, said second rotatable member heating said first rotatable member through the heating nip;

a back-up member configured to form a conveying nip, between said back-up member and said first rotatable member, for conveying and heating the recording material; and a potential controller configured to control a surface potential of aid second rotatable member so that a polarity of the surface potential of said second rotatable member is opposite to a charge polarity of the toner.

2. The image heating apparatus according to claim 1, wherein said potential controller is a DC power source.

3. The image heating apparatus according to claim 1, wherein said potential controller is a diode.

4. The image heating apparatus according to claim 1, wherein said second rotatable member is an endless belt, and wherein the apparatus further comprises a heater contacting an inner surface of the belt and forming the heating nip with said first rotatable member via the belt.

5. The image heating apparatus according to claim 1, wherein said first rotatable member includes a metal core, a rubber layer formed outside the metal core, and a surface layer made of a fluororesin outside the rubber layer, and wherein the metal core is grounded.

6. The image heating apparatus according to claim 1, wherein said second rotatable member is grounded.

7. An image heating apparatus for heating a toner image formed on a recording material, comprising:

a first rotatable member contactable to the toner image;

a second rotatable member configured to form a heating nip between itself and said first rotatable member by contacting an outer surface of said first rotatable member, said second rotatable member heating said first rotatable member through the heating nip; and a back-up member configured to form a conveying nip, between said back-up member an said first rotatable member, for conveying and heating the recording material, wherein a potential difference, between said first rotatable member and said second rotatable member, is generated so that a contamination electrically charged to a polarity opposite to a toner charge polarity receives an electrostatic force in a direction from said second rotatable member to said first rotatable member.

8. The image heating apparatus according to claim 7, wherein a potential difference, between said first rotatable member and said back-up member, is generated so that the contamination receives an electrostatic force in a direction from said back-up member to said first rotatable member.

9. The image heating apparatus according to claim 6, wherein said second rotatable member is an endless belt, and wherein the apparatus further comprises a heater contacting an inner surface of the belt and forming the heating nip with first rotatable member via the belt.

10. The image heating apparatus according to claim 6, wherein a DC power source generates the potential difference.

11. The image heating apparatus according to claim 6, wherein a diode generates the potential difference.

12. The image heating apparatus according to claim 6, wherein said first rotatable member includes a metal core, a rubber layer formed outside the metal core, and a surface layer made of a fluororesin outside the rubber layer, and wherein the metal core is grounded.

13. The image heating apparatus according to claim 12, wherein said second rotatable member is grounded.

* * * * *